United States Patent [19]

Ichikawa et al.

[11] Patent Number: 5,035,991

[45] **Date of Patent: * Jul. 30, 1991**

[54] CONTROL PROCESS AND APPARATUS FOR THE FORMATION OF SILVER HALIDE GRAINS

[75] Inventors: Yasunori Ichikawa; Hiroshi Ohnishi; Shigeharu Urabe; Akira Kojima; Akira Katoh, all of Kanagawa, Japan

[73] Assignee: Fuji Photo Film Co., Ltd., Kanagawa, Japan

[ * ] Notice: The portion of the term of this patent subsequent to Nov. 7, 2006 has been disclaimed.

[21] Appl. No.: 454,254

[22] Filed: Dec. 21, 1989

[30] Foreign Application Priority Data

Dec. 22, 1988 [JP] Japan ..... 63-322171

[51] Int. Cl.[5] ..... G03C 1/015

[52] U.S. Cl. ..... 430/569; 430/567

[58] Field of Search ..... 430/569, 567

[56] References Cited

U.S. PATENT DOCUMENTS 3,821,002 6/1974 Culhane et al. ..... 430/569

4,879,208 11/1989 Urabe ..... 430/569

OTHER PUBLICATIONS

Patent Abstracts of Japan, vol. 10, No. 300 (P-506)(2356), Oct. 14, 1986 and JP-A-61 11533 (Konishiroku Photo Ind. Co. Ltd.), Jun. 4, 1986, *whole document*.

Chemical Abstracts, vol. 108, No. 12, Mar. 21, 1988, Columbus, Ohio, U.S.A., p. 163; Ref. No. 97240N and JP-62-275023 (Fuji) *abstract*.

European Search Report No. EP 89 12 3808, May 7, 1990.

*Primary Examiner*—Charles L. Bowers, Jr.

*Assistant Examiner*—Janis L. Dote

*Attorney, Agent, or Firm*—Sughrue, Mion, Zinn, Macpeak & Seas

[57] ABSTRACT

A control process and apparatus for the formation of silver halide grains comprising a mixer disposed outside of a reaction vessel containing an aqueous protective colloid solution and causing a nucleus formation (nucleation) and/or a crystal growth of silver halide grains. The process and apparatus further include: supplying an aqueous solution of a water-soluble silver salt, an aqueous solution of water-soluble halide(s), and an aqueous solution of a protective colloid to the mixer through supply conduits while controlling the flow rates of the solutions; mixing them while controlling the rotational speed of a stirrer of the mixer to form fine, silver halide grains; and immediately supplying the fine grains into the reaction vessel through a conduit connecting the mixer to the reaction vessel to perform the nucleus formation and/or the crystal growth of the silver halide grains in the reaction vessel. The control process and apparatus further comprise measuring the silver ion potential of the fine grains formed in the mixer or the silver ion potential in the reaction vessel with an electrode, and controlling the flow rate of at least one of the aqueous silver salt solution, the aqueous halide solution, and the aqueous protective colloid solution being added to the mixer, such that the measured value equals a predetermined value.

1 Claim, 2 Drawing Sheets

CONTROL PROCESS AND APPARATUS FOR THE FORMATION OF SILVER HALIDE GRAINS

FIELD OF THE INVENTION

This invention relates to a control process and apparatus for the formation of silver halide grains and, more particularly, to a control process and apparatus for the formation of silver halide grains in the production of a photographic emulsion wherein the halide composition of the silver halide crystals is completely homogeneous and no halide distribution exists among the silver halide grains.

BACKGROUND OF THE INVENTION

The formation of silver halide grains is composed of two main steps, a nuclear formation (nucleation) and a crystal growth. In T. H. James, *The Theory of the Photographic Process,* 4th edition, page 89, published by Macmillan Co., 1977, it is disclosed that "[a]lthough crystallization is often considered to consist of two major processes, nucleation and growth, two additional processes occur under some conditions of photographic emulsion precipitation, Ostwald ripening and recrystallization. Nucleation is the process in which there is a population explosion of the number of crystals when entirely new crystals are created. Growth is the addition of new layers to crystals that are already present. Ostwald ripening occurs predominantly at a higher temperature, in the presence of solvents, and when there is a wide distribution of grain sizes. Recrystallization is the process in which the composition of crystals changes." That is, since in the formation of silver halide grains, nuclei are formed at the beginning and the subsequent crystal growth mainly occurs on the existing nuclei only, the number of the silver halide grains does not increase during the growth of the grains.

Silver halide grains are generally produced by reacting an aqueous silver salt solution and an aqueous halide solution in an aqueous colloid solution contained in a reaction vessel. In this case, there is known a single jet process of placing an aqueous solution of a protective colloid, such as gelatin, and an aqueous halide solution in a reaction vessel and adding thereto an aqueous silver salt solution along with stirring for a certain time. Also known is a double jet process of placing an aqueous gelatin solution in a reaction vessel and simultaneously adding an aqueous halide solution and an aqueous silver salt solution each for a certain time. Upon comparing both of the processes with each other, in the double jet process, silver halide grains having a narrower grain size variation are obtained and, further, the halide composition can be desirably changed with the growth of the grains.

Also, it is known that the nucleus formation of silver halide grains is greatly changed by the concentration of silver ions (or halogen ions) in the reaction solutions, the concentration of a silver halide solvent, the supersaturation, the temperature, etc. In particular, the heterogeneity of a silver ion concentration or a halogen ion concentration caused by an aqueous silver salt solution and an aqueous halide solution added to a reaction vessel causes the variation of supersaturation and solubility in the reaction vessel by each concentration, thereby the nucleus formation rate differs to cause a heterogeneity in the silver halide crystal nuclei formed.

In order to avoid the occurrence of the heterogeneity described above, it is necessary to quickly and uniformly mix the aqueous silver salt solution and the aqueous halide solution being supplied to the aqueous colloid solution for homogenizing the silver ion concentration or the halogen ion concentration in the reaction vessel.

In a conventional process of adding an aqueous halide solution and an aqueous silver salt solution to the surface of an aqueous colloid solution in a reaction vessel, the portions having a high halogen ion concentration and a high silver ion concentration occur near the addition locations of the aqueous solutions, which makes it difficult to produce homogeneous silver halide grains. For improving the local deviation of the concentrations, there are known the techniques disclosed in U.S. Pat. Nos. 3,415,650 an 3,692,283 and British Patent No. 1,323,464.

In these processes, a hollow rotary mixer (filled with an aqueous colloid solution and being preferably, partitioned into upper and lower chambers by a disk-form plate) having slits in the cylindrical walls thereof is disposed in a reaction vessel filled with an aqueous colloid solution in such a manner that the rotary axis is placed in the gravity of direction. Further, an aqueous halide solution and an aqueous silver salt solution are supplied into the mixer, which is rotating at a high speed, through conduits from the upper and lower open ends and mixed quickly to react the solutions (i.e., when the mixer is partitioned into the upper and lower chambers by a partition disk, the aqueous halide solution and .the aqueous silver salt solution supplied to the upper and lower chambers, respectively, are diluted with the aqueous colloid solution filled in both the chambers and then quickly mixed near the outlet slit of the mixer to cause the reaction). The silver halide grains thus formed are discharged into the aqueous colloid solution in the reaction vessel by the centrifugal force caused by the rotation of the mixer to form silver halide grains.

On the other hand, JP-B-55-10545 (the term "JP-B" as used herein means an "examined published Japanese patent application") discloses a technique of improving the local deviation of the concentrations to prevent the occurrence of the heterogeneous growth of silver halide grains. The process is a technique of separately supplying an aqueous halide solution and an aqueous silver salt solution into a mixer filled with an aqueous colloid solution from the lower open end, the mixer being placed in a reaction vessel filled with an aqueous colloid solution, abruptly stirring and mixing the reaction solutions with a lower stirring blade (turbine propeller) provided in the mixer to grow silver halide grains, and immediately discharging the silver halide grains thus grown into the aqueous colloid solution in the reaction vessel from an upper opening of the mixer by means of an upper stirring blade provided in the upper portion of the aforesaid mixer.

Also, JP-A-57-92523 j(the term "JP-A" as used herein means an "unexamined published Japanese patent application") discloses a production process of silver halide grains for similarly preventing the occurrence of local heterogeneity of the concentrations. That is, there is disclosed a process of separately supplying an aqueous silver salt solution into a mixer filled with an aqueous colloid solution from a lower open end, the mixer being disposed in a reaction vessel filled with an aqueous colloid solution. The process further includes diluting both the reaction solutions with the aqueous colloid solution, abruptly stirring and mixing the reaction solutions by a lower stirring blade member provided in the mixer, and immediately discharging the silver halide grains thus grown into the aqueous colloid solution in the reaction vessel from an upper opening of the mixer. As a result, both the reaction solutions, diluted with the aqueous colloid solution as described above, are passed through a gap formed between the inside wall of the aforesaid mixer and the end of a blade of the aforesaid stirring blade member, without passing through gaps between the individual blades of the stirring blade member, so as to abruptly mix the reaction solutions due to the shearing effect in the aforesaid gap and thus cause the reaction to thereby grow silver halide grains.

However, although in the aforesaid processes, the occurrence of the local heterogeneity of the concentrations of silver ions and halogen ions in the reaction vessel can be surely prevented to a considerable extent, the heterogeneity of the concentrations still exists in the mixer and, in particular, a considerably large variation of the concentrations exists near the nozzles for supplying the aqueous silver salt solution and the aqueous halide solution, and near the lower portion and the stirring portion of the stirring blade member. Furthermore, the silver halide grains supplied to the mixer together with the protective colloid are passed through the portions having such a heterogeneous distribution of the concentrations and, more importantly, are rapidly grown in these portions. In other words, in these processes, the variation of the concentrations exists in the mixer and since the grain growth rapidly occurs in the mixer, the purpose of performing a homogeneous nucleus formation and a homogeneous grain growth of silver halide grains in a state having no variation of the concentrations has not been attained.

Furthermore, various attempts have been made for solving the problem of the heterogeneous distribution of the silver ion concentration and the halogen ion concentration by more completely mixing wherein a reaction vessel and a mixer are separately disposed and an aqueous silver salt solution and an aqueous halide solution are supplied to the mixer and abruptly mixed therein to form silver halide grains.

For example, U.S. Pat. No. 4,171,224 and JP-B-48-21045 disclose a process and an apparatus for circulating an aqueous colloid solution (containing silver halide grains) in a reaction vessel at the bottom of the reaction vessel by means of a pump, disposing a mixer in the circulating route, supplying an aqueous silver salt solution and an aqueous halide solution to the mixer, and abruptly mixing both the aqueous solutions in the mixer to form silver halide grains.

Also, U.S. Pat. No. 3,897,935 discloses a process of circulating an aqueous protective colloid solution (containing silver halide grains) in a reaction vessel at the bottom of the reaction vessel by means of a pump and adding an aqueous halide solution and an aqueous silver salt solution into the circulation system.

Furthermore, JP-A-53-47397 discloses a process and an apparatus for circulating an aqueous colloid solution (containing silver halide emulsion) in a reaction vessel by means of a pump, including first adding an aqueous alkali metal halide solution into the circulation system, and after diffusing the solution until the mixture becomes uniform, and adding an aqueous silver halide solution into the system followed by a mixing step to form silver halide grains.

However, in these processes, while the flow rate of the aqueous solution circulated in the reaction vessel and the stirring efficiency of the mixer can be separately changed, and the grain formation can be performed under a condition of a more homogeneous distribution of the concentrations, eventually, the silver halide crystals sent from the reaction vessel together with the aqueous colloid solution cause an abrupt grain growth at the inlets of the aqueous silver salt solution and the aqueous halide solution. Accordingly, it is practically impossible to prevent the formation of the variation of the concentrations at the mixing portion or near the inlets as in the case described above, and thus, the purpose of homogeneously forming silver halide grains in a state having no variation of the concentrations has not yet been attained.

SUMMARY OF THE INVENTION

The object of the present invention is to solve the aforesaid problems with respect to nucleus formation and/or crystal growth in the heterogeneous field of the concentrations (of silver ions and halogen ions) in the aforementioned conventional production techniques and the formation, thereby, of heterogeneous silver halide grains (grain sizes, crystal habits, the halogen distribution among and in the silver halide grains).

The inventors previously proposed "a process of performing a nucleus formation of silver halide grains" in a reaction vessel by disposing a mixer outside of the reaction vessel for causing the nucleus formation and the crystal growth of silver halide grains including the steps of forming silver halide grains, supplying an aqueous solution of a water-soluble silver salt and an aqueous solution of water-soluble halide(s) into the mixer and mixing them to form silver halide, fine grains, and immediately supplying the fine grains into the reaction vessel (Japanese Patent Application 63-195778). Further, "a process of causing the crystal growth of silver halide grains" in the same manner as above was proposed (Japanese Patent Application 63-7851). The present invention relates to further improvements of these inventions.

That is, it has now been discovered that the aforesaid object can be achieved by the present invention as set forth hereinbelow.

Thus, according to one aspect of this invention, there is provided a control process for the formation of silver halide grains by disposing a mixer outside of a reaction vessel containing an aqueous protective colloid solution and causing a nucleus formation (nucleation) and/or a crystal growth of silver halide grains. The process further includes the steps of: supplying an aqueous solution of a water-soluble silver salt, an aqueous solution of water-soluble halide(s), and an aqueous solution of a protective colloid to the mixer while controlling the flow rates of the solutions; mixing them while controlling the rotational speed of a stirrer of the mixer to form fine, silver halide grains; and immediately supplying the fine grains into the reaction vessel to perform the nucleus formation and/or the crystal growth of the silver halide grains in the reaction vessel. The control process further comprises measuring the silver ion potential of the fine grains formed in the mixer or the silver ion potential in the reaction vessel, and controlling the flow rate of at least one of the aqueous silver salt solution, the aqueous halide solution, and the aqueous protective colloid solution being added to the mixer, such that the measured value equals a predetermined value.

According to another aspect of this invention, there is provided a control apparatus for the formation of silver halide grains in an apparatus for forming silver halide grains comprising a reaction vessel for causing a nucleus formation and/or a crystal growth of silver halide grains. The control apparatus further includes: a mixer having a stirrer and being disposed outside of the reaction vessel; means for supplying an aqueous solution of a water-soluble silver salt, an aqueous solution of a water-soluble halide(s), and an aqueous solution of a protective colloid to the mixer while controlling the flow rates of these solutions; a means for controlling the rotational speed of the stirrer of the mixer; and a conduit for connecting the mixer to the reaction vessel for immediately supplying the reaction product in the mixer to the reaction vessel. The control apparatus includes an electrode for measuring a silver ion potential disposed in the mixer or in the conduit connecting the mixer to the reaction vessel, and a control means for generating a signal for controlling the flow rate of at least one of the aqueous silver salt solution, the aqueous halide solution, and the aqueous protective colloid solution being added to the mixer such that the measured value of the silver ion potential, as measured by the aforesaid electrode, equals a predetermined value.

According to a still further aspect of this invention, there is provided a control apparatus for the formation of silver halide grains as described immediately above, wherein the electrode for measuring the silver ion potential is disposed in the reaction vessel instead of being placed in the conduit for connecting the mixer to the reaction vessel.

DESCRIPTION OF THE INVENTION

The term "nuclei", in this invention, means newly forming silver halide grains during the formation of the silver halide grains and in a stage of changing the number of the silver halide crystals, and such silver halide grains which are in a stage of causing only the growth of nuclei, without changing the number of silver halide crystals, are referred to as grains causing the growth only.

In the step of the nucleus formation, the generation of new nuclei, the dissolution of already existing nuclei, and also the growth of nuclei occur simultaneously.

In the practice of the nucleus formation and/or the grain growth by the invention, it is important that the aqueous silver halide solution and the aqueous halide solution are not added to the reaction vessel, and that the aqueous protective colloid solution (containing silver halide grains) in the reaction vessel is not recycled into the mixer. Thus, the process and apparatus of this invention are completely different from conventional systems and are a novel process and apparatus for obtaining homogeneous silver halide grains.

Figure 1A:
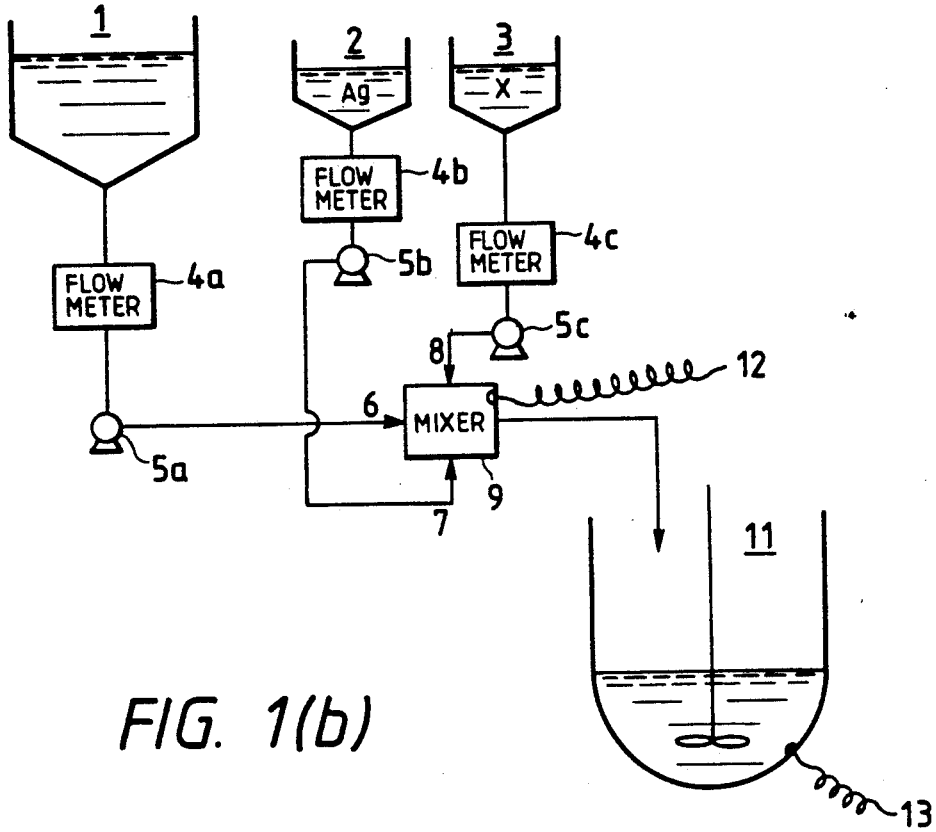
FIGS. 1 (*a*) and 1(*b*) are flow diagrams each showing an embodiment of the system of the control process and apparatus for the formation of silver halide grains according to this invention.
Figure 1B:
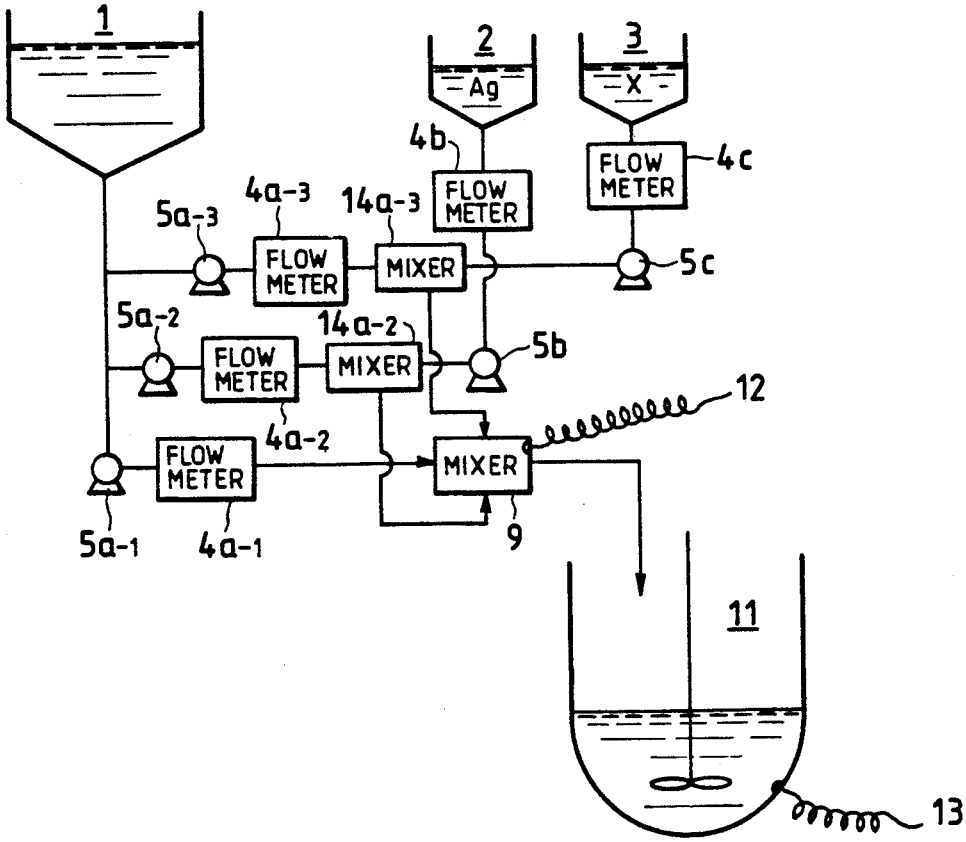

FIG. 1(*a*) is a flow diagram showing an embodiment of the control process or apparatus of this invention.

An aqueous protective colloid solution is prepared in a tank 1, an aqueous silver salt solution in a tank 2, and an aqueous halide solution in a tank 3, and these aqueous solutions are supplied to a mixer 9 from supply systems or conduits 6, 7, and 8, respectively, while the flow rates of these solutions are measured by flow meters 4*a*, 4*b*, and 4*c* for controlling the flow rates of pumps 5*a*, 5*b*, and 5*c*, respectively. The mixer 9 is equipped with a stirrer (as will be described below in detail) and the aforementioned three solutions are mixed in the mixer while controlling the rotational speed of the blade (propeller) of the stirrer to form fine, silver halide grains in the mixer 9. The fine grains formed are immediately supplied into a reaction vessel 11, and the nucleus formation and/or the crystal growth of silver halide grains in the reaction vessel 11 are performed.

In this case, the silver ion potential of the fine grains formed in the mixer 9 or the silver ion potential in the reaction vessel 11 is measured by silver ion potential measuring electrodes 12 or 13, respectively, and the flow rates of the aqueous silver salt solution, the aqueous halide solution, and/or the aqueous protective colloid solution being added to the mixer 9 are controlled by the feed pumps 5*a*, 5*b*, and 5*c*, respectively, such that the measured value of the silver ion potential equals a predetermined value.

In this invention, the system shown in FIG. 1 (*b*) may be employed. In this system, a portion of an aqueous rotective colloid solution prepared in a tank 1 is directly supplied to a mixer 9, while the remainder of the aqueous colloid solution is divided into two portions, each for diluting an aqueous silver salt solution prepared in a tank 2 or an aqueous halide solution prepared in a tank 3 before supplying the solutions to the mixer 9. The flow rates of the three portions of the aqueous protective colloid solutions are measured by flow meters 4*a*-1, 4*a*-2, and 4*a*-3, respectively, and the aqueous silver salt solution and aqueous halide solution are diluted with the aqueous protective colloid solution in mixers 14*a*-2 and 14*a*-3, respectively, before being supplied to the mixer 9. In this case, the flow rates of the three portions of the aqueous protective colloid solutions and the flow rates of the aqueous silver salt solution and the aqueous halide solution are properly controlled by pumps 5*a*-1, 5*a*-2, 5*a*-3, 5*b*, and 5*c* such that the silver potential of the fine grains formed in the mixer, as measured by a silver ion potential measuring electrode 12, or the silver ion potential in the reaction chamber, as measured by a silver ion potential measuring electrode 13, equals a predetermined value.

In FIGS. 1 (*a*) and 1 (*b*), the silver ion potential measuring electrode 12 or 13 is disposed in the mixer 9 or in the reaction vessel 11 for detecting pAg in the mixer 9 or the reaction vessel 11, respectively. In addition, when pAg in the mixer 9 is used to control according to the requirement for the composition of the silver halide grains formed, the flow rate of the aqueous silver salt solution and/or the aqueous halide solution is controlled using a signal from the electrode 12 disposed in the mixer 9. Also, in the system shown in FIG. 1 (*b*), in the case of controlling the flow rate of the silver salt solution and/or the halide solution, the flow rate of the aqueous protective solution for diluting the aqueous silver salt solution and the aqueous halide solution is controlled by the flow meter 4*a*-2 and/or the flow meter 4*a*-3 in conformity with the control of the aqueous silver salt solution and/or the aqueous halide solution.

Furthermore, when the grain growth is performed at a constant pAg in the reaction vessel 11, the flow rate of the aqueous silver salt solution and/or the aqueous halide solution is controlled using the signal from the electrode 13 disposed in the reaction vessel 11.

The relation between the mixer and the reaction vessel in this invention will now be described in detail.

Figure 2:
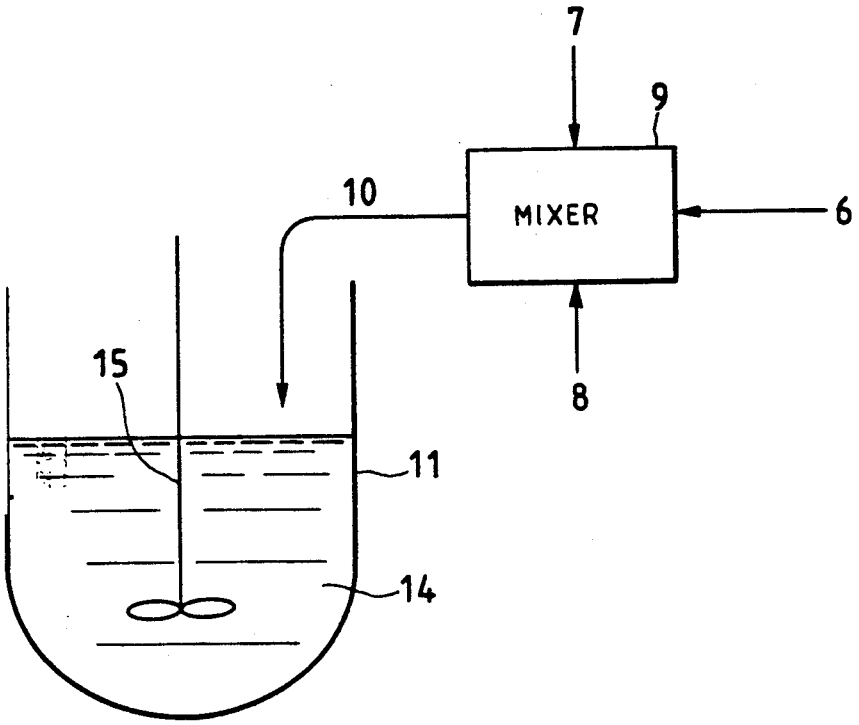
FIG. 2 is a flow diagram showing the relation of the mixer and the reaction vessel for use in this invention.

In FIG. 2, a reaction vessel 11 contains an aqueous protective colloid solution 14. The aqueous protective colloid solution 14 is stirred by a propeller or blade disposed on a rotary shaft of a stirrer 15. An aqueous silver salt solution, an aqueous halide solution, and an aqueous protective colloid solution are introduced into a mixer 9 disposed outside of the reaction vessel 11 by addition systems or conduits 7, 8, and 6, respectively. In this case, the aqueous silver salt solution and the aqueous halide solution may be previously diluted with the aqueous protective colloid solution before being supplied to the mixer 9 as shown in FIG. 1 (*b*). These solutions are abruptly and strongly mixed in the mixer 9 and the silver halide fine grains formed in the mixer are immediately introduced into the reaction vessel 11 through an introduction system 10.

Figure 3:
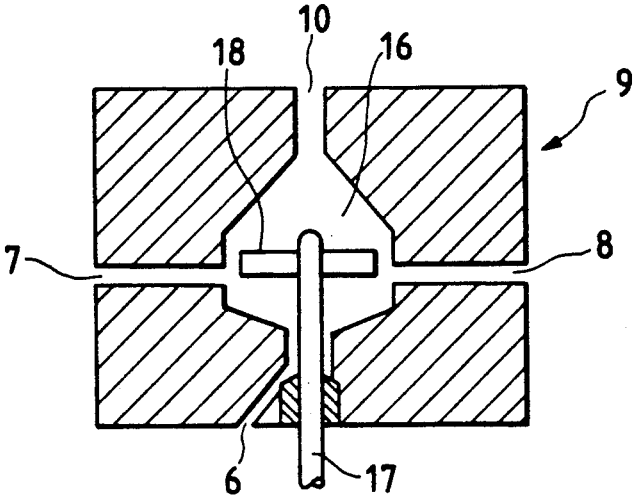
FIG. 3 is cross-sectional view of an embodiment of the mixer for use in this invention.

FIG. 3 shows the details of the mixer 9. The mixer 9 has a reaction chamber 16 on the inside thereof and a rotary shaft 17 having a stirring blade 18 is positioned in the reaction chamber 16. An aqueous silver salt solution, an aqueous halide solution, and an aqueous protective colloid solution are added to the reaction chamber 16 through three inlet conduits (i.e., 7 and 8, and another conduit 6 which is not shown in the FIG. 3).

By rotating the rotary shaft at a high speed (higher than about 1000 r.p.m., preferably higher than 2000 r.p.m., and more preferably higher than 3000 r.p.m.), the solution containing very fine grains formed by quickly and strongly mixing the solutions is immediately introduced into the reaction vessel from the conduit 10. After being introduced into the reaction vessel 11, the very fine grains formed in the mixer 9 are easily dissolved owing to the fineness of the grain sizes to form silver ions and halogen ions again and thus cause a homogeneous nucleus formation and/or crystal growth.

The halide composition of the very fine silver halide grains is selected to be same as the halide composition of the desired silver halide grains. The fine grains introduced into the reaction vessel 11 are dispersed in the reaction vessel by stirring in the reaction vessel and halogen ions and silver ions of the desired halide composition are released from each fine grain. The size of the grains formed in the mixer 9 is very fine, the number of grains is very large, and since the silver ions and halogen ions (in the case of growing mixed crystals, the composition of the halogen ions is the same as the desired halogen ion composition) are released from such a large number of grains and the release thereof occurs throughout the entire protective colloid in the reaction vessel, the result is completely homogeneous nucleus formation and crystal growth.

In this case, it is important that the silver ions and the halogen ions are not added to the reaction vessel 11 as aqueous solutions, and that the aqueous protective colloid solution in the reaction vessel 11 is not recycled into the mixer 9.

With respect to the aforesaid point, the process of this invention is completely different from conventional processes and can have an astonishing effect on the nucleus formation and the crystal growth of silver halide grains.

The fine grains formed in the mixer have a very high solubility since the grain sizes thereof are very fine and are easily dissolved to form silver ions and halogen ions again when they are added to the reaction vessel. Hence, the ions are deposited on a very slight part of the fine grains thus introduced into the reaction vessel to form silver halide nuclei and to accelerate the crystal growth, but the fine grains together cause so-called Ostwald ripening due to the high solubility to increase the grain sizes.

In this case, if the size of the fine, silver halide grains being introduced into the reaction vessel are increased, the solubility of the grains is lowered to delay the dissolution thereof in the reaction vessel, which results in greatly reducing the nucleus formation rate. In some cases, the grains can no longer be dissolved, thereby an effective nucleus formation cannot be performed and, on the contrary, the grains themselves become nuclei to cause grain growth.

In this invention, the problem is solved by the following these techniques:

(1) After forming fine grains in the mixer, the grains are immediately added to the reaction vessel.

As will be described below, it is known that fine grains are previously formed to provide a fine grain silver halide emulsion, thereafter, the emulsion is re-dissolved, and the dissolved fine grain emulsion is added to a reaction vessel containing silver halide grains becoming nuclei and a silver halide solvent to cause the grain formation. However, in such a process, the very fine grains once formed cause Ostwald ripening in the step of grain formation, the step of washing, the step of re-dispersion, and the step of re-dissolution to increase the grains size.

In this invention, the occurrence of Ostwald ripening is prevented by disposing a mixer at a position very near the reaction vessel and shortening the residence time of the added solutions in the mixer, that is, by immediately adding the fine grains formed in the mixer to the reaction vessel. Practically, the residence time t of the solutions added to the mixer is shown by the following equation:

$$t = \frac{v}{a + b + c}$$

V: Volume (ml) of the reaction chamber of the mixer.

a: Addition amount (ml/min.) of an aqueous silver nitrate solution.

b: Addition amount (ml/min.) of an aqueous halide solution.

c: Addition amount (ml/min.) of an aqueous protective colloid solution.

(In this invention, however, the amount c contains the amount of the aqueous protective colloid solution previously used for diluting the aqueous silver nitrate solution and the aqueous halide solution.)

In the production process of this invention, the residence time t is not longer than 10 minutes, preferably not longer than 5 minutes, more preferably not longer than 1 minute, and particularly preferably not longer than 20 seconds. The fine grains thus obtained in the mixer are immediately added to the reaction vessel without increasing the grain sizes.

From the aforesaid viewpoint, the control of the flow rates of an aqueous silver salt solution, an aqueous halide solution, and an aqueous protective colloid solution plays an important role in this invention. One of the features of this invention is in this aspect, namely the flow rate of the sum of the aforesaid addition amounts a, b, and c is controlled while keeping the ratios of them constant.

(2) The solutions are stirred strongly and efficiently in the mixer.

In T. H. James, *The Theory of the Photographic Process*, page 93, he discloses that "[a]nother type of grain growth that can occur is coalescence. In coalescence ripening, an abrupt change in size occurs when pairs or larger aggregates of crystals are formed by direct contact and are welded together from crystals that were widely separated. Both Ostwald and coalescence ripening may occur during precipitation, as well as after precipitation has stopped."

The coalescence ripening described above is liable to occur when the grain sizes are very small and is liable to occur when stirring is insufficient. In the extreme case, the silver halide grains sometimes form coarse massive grains. On the other hand, in this invention, since a closed type mixer as shown in FIG. 3 is used, the stirring blade in the reaction chamber can be rotated at a high rotational speed. High speed stirring has never been practiced in the conventional open type reaction vessel (in the open type reaction vessel, when a stirring blade is rotated at a high rotational speed, the liquid in the vessel is scattered away and foam is formed by centrifugal force, which makes is practically impossible to use such as system). The present invention prevents the occurrence of the aforesaid coalescence ripening, thereby allowing silver halide grains having very fine grain sizes to be obtained.

In this invention, the rotation number or speed of the stirring blade is at least 1,000 r.p.m., preferably at least 2,000 r.p.m., and more preferably at least 3,000 r.p.m.

Accordingly, the control of the rotation number of the stirring blade in the mixer plays an important role.

(3) Injection of an aqueous protective colloid solution into the mixer.

The occurrence of the aforesaid coalescence ripening can be remarkably prevented by a protective colloid for the fine, silver halide grains. I this invention, the aqueous protective colloid solution is added to the mixer by the following method.

(a) The aqueous protective colloid solution is separately added to the mixer.

The concentration of the protective colloid is at least 0.2% by weight, and preferably at least 0.5% by weight and the flow rate of the aqueous protective colloid solution is at least 20%, preferably at least 50%, and more preferably at least 100% of the sum of the flow rate of the aqueous silver nitrate solution and the flow rate of the aqueous halide solution being added to the mixer. In the present invention, this method is employed.

(b) The protective colloid is contained in the aqueous halide solution being added to the mixer.

The concentration of the protective colloid is at least 0.2% by weight, and preferably at least 0.5% by weight.

(c) The protective colloid is contained in the aqueous silver nitrate solution being added to the mixer.

The concentration of the protective colloid is at least 0.2% by weight, and preferably at least 0.5% by weight. When gelatin is used as the protective colloid, since gelatin silver may be formed from silver ions and gelatin if the mixture is stored for a long time and silver colloid may be formed by the photodecomposition and/or the thermal decomposition thereof, it is preferred to mix the aqueous silver salt solution and the aqueous gelatin solution directly before use.

Also, as to the aforesaid methods (a), (b), and (c), the method (a) may be used singly, a combination of the methods (a) and (b) or the methods (a) and (c), or a combination of the methods (a), (b), and (c) may be used.

In this invention, gelatin is usually used as the protective colloid but other hydrophilic colloids can also be used. Practically, the hydrophilic colloids which can be used in this invention are described in *Research Disclosure*, Vol. 176, No. 17643, Paragraph IX (December, 1978).

The grain sizes obtained by the aforesaid techniques (1) to (3) can be confirmed by a transmission type electron microscope on a mesh and in this case, the magnification is from 20,000 to 40,000 magnifications.

The sizes of the fine grains obtained by the process of this invention are not larger than 0.06 μm, preferably not larger than 0.03 μm, and more preferably not larger than 0.01 μm.

U.S. Pat. No. 2,146,938 discloses a method of forming a coarse grain silver halide emulsion by mixing coarse silver halide grains having adsorbed thereto no absorptive material and fine, silver halide grains having adsorbed thereto no adsorptive material or by slowly adding a fine grain silver halide emulsion to a coarse grain silver halide emulsion. In the method, the fine grain emulsion previously prepared is added and thus the process is completely different from the process of this invention.

Also, U.S. Pat. No. 4,379,837 discloses a process of growing silver halide grains by washing and dispersing a fine grain silver halide emulsion prepared in the presence of a grain growing inhibitor, re-dissolving the emulsion, and adding the dissolved emulsion to silver halide grains being grown. But the process is also completely different form the process of this invention for the same reasons as described above.

T. H. James, *The Theory of the Photographic Process*, 4th edition, cites a Lippmann emulsion as a fine grain silver halide emulsion and describes that the mean grain size is 0.05 μm. It is possible to obtain fine silver grains having a mean size of not larger than 0.05 μm, but even if such fine grains are obtained, the grains are unstable and the grain sizes are easily increased by Ostwald ripening. When an adsorptive material is adsorbed on fine grains as in the process disclosed in U.S. Pat. No. 4,379,837, the occurrence of Ostwald ripening may be prevented to some extent, but the dissolution speed of the fine grains is reduced by the presence of the absorptive material, which is contrary to the intention of this invention.

U.S. Pat. Nos. 3,317,322 and 3,206,313 disclose a process of forming core/shell grains by mixing a chemically sensitized emulsion of silver halide grains having a mean grain size of at least 0.8 μm, which are to be the cores, with an emulsion of silver halide grains, which are not chemically sensitized and which have a mean grain size of not larger than 0.4 μm, to perform the ripening. However, the process is completely different from the process of the present invention since in the aforesaid process, the fine grain emulsion is a silver halide emulsion previously prepared and ripening is performed by mixing two kinds of silver halide emulsions.

JP-A-62-99751 discloses a photographic element containing tabular silver bromide or silver iodobromide emulsion having a mean grain size of from 0.4 to 0.55 μm and having an aspect ratio of at least 8. Also, U.S. Pat. No. 4,672,027 discloses a photographic element containing tabular silver bromide or silver iodobromide emulsion having a mean grain size of from 0.2 to 0.55 μm, but in the growth of tabular silver iodobromide grains described in the examples, the tabular silver iodobromide grains are grown by adding an aqueous silver nitrate solution and an aqueous bromide solution to a reaction vessel containing an aqueous solution of a protective colloid (bone gelatin) by a double jet method and simultaneously supplying iodine as a silver iodide emulsion (mean grain size of about 0.05 μm, bone gelatin 40 g/mol-Ag). In the process, an aqueous silver nitrate solution and an aqueous halide solution are added to a reaction vessel simultaneously with the addition of silver halide, fine grains and, hence, the process is completely different from the process of this invention.

In U.S. Pat. No. 4,457,101, it is disclosed that "silver, a bromide, and an iodide can be introduced at the beginning or in the growing state as a form of fine silver halide grains dispersed in a dispersion medium. That is, silver bromide grains, silver iodide grains and/or silver iodobromide grains can be introduced."

However, the above description is only a general description of using a fine grain emulsion for the formation of silver halide and does not show the process and the system of the present invention.

JP-A-62-124500 discloses an example of growing host grains in a reaction vessel using very fine silver halide grains previously prepared, but in the process, a fine grain silver halide emulsion previously prepared is added and, hence, the process is completely different from the process of the present invention.

In the conventional processes described above, since a fine grain silver halide emulsion is previously prepared and the emulsion is re-dissolve for use, silver halide grains having fine grain sizes cannot be obtained. Accordingly, these grains having relatively large grain sizes cannot be quickly dissolved in a solution in a reaction vessel, a very long period of time or a large amount of silver halide solvent is required for completing the dissolution thereof. In such a circumstance, the nucleus formation is performed at a very low supersaturation for the grains being grown in a vessel, which results in greatly broadening the grain size variation of the nuclei and thus causing the reduction of properties such as the broadening of the grain size variation of silver halide grains formed, the reduction of the photographic gradation, the reduction of sensitivity by the heterogeneous chemical sensitization (it is impossible to most suitably chemically sensitize silver halide grains having large grain sizes and silver halide grains having small grain sizes simultaneously), the increase of fog, the deterioration of graininess, etc.

Furthermore, in the conventional processes, there are many steps of grain formation, washing, dispersion, cooling, storage, and re-dispersion, thereby the production costs become high and also there are many restrictions on the addition system of an emulsion as compared with the addition system of other solutions.

These problems can be solved by the process and apparatus of this invention. That is, since very fine grains are introduced into the reaction vessel by the process of this invention, the solubility of the fine grains is high, thereby the dissolution rate is high and the grains being grown in the reaction vessel cause the nucleus formation and/or the crystal growth under a high super-saturation condition. Accordingly, the size distribution of the nuclei and/or the crystal grains formed is not broadened. Furthermore, since the fine grains formed in the mixer are added to the reaction vessel as disclosed, there is no problem with the production cost.

When a silver halide solvent is used in .the reaction vessel in the process of this invention, a far higher dissolution rate of fine grains and the far higher nucleation rate and crystal growing rate of grains in the reaction vessel is obtained.

As a silver halide solvent, there are a water-soluble bromide, a water-soluble chloride, a thiocyanate, ammonia, a thioether, a thiourea, etc.

For example, there are thiocyanates (described in U.S. Pat. Nos. 2,222,264, 2,448,534 and 3,320,069), ammonia, thioether compounds (described in U.S. Pat. Nos. 3,271,157, 3,574,628, 3,704,130, 4,297,439, and 4,276,345), thione compounds (described in JP-A-53-144319, 53-82408, and 55-77737), amine compounds (described in JP-A-54-100717), thiourea derivatives (described in JP-A-55-2982), imidazoles (described in JP-A-54-100717), and substituted mercaptotetrazoles (described in JP-A-57-202531).

According to the process and apparatus of this invention, the supplying rates of silver ions and halide ions to the mixer may be desirably controlled. The supplying rates may be constant, but it is preferred to gradually increase the supplying rates. Such methods are described in JP-B-48-36890 and U.S. Pat. No. 3,672,900.

Furthermore, according to the process and apparatus of this invention, the halogen composition during the crystal growth may be controlled. For example, in the case of silver iodobromide, it is possible to maintain a definite content of silver iodide, continuously increase the content of silver iodide, continuously decrease the content of silver iodide, or change the content of silver iodide after a certain time.

The reaction temperature in the mixer is not higher than 60° C., preferably not higher than 50° C., and more preferably not higher than 40° C.

With a reaction temperature of lower than about 35° C., ordinary gelatin is liable to coagulate and it is preferred to use a low molecular weight gelatin (mean molecular weight of less than about 30,000).

Such a low molecular weight gelatin which is preferably used in this invention, can usually be prepared as follows. Ordinary gelatin having a mean molecular weight of about 100,000 is dissolved in water and then the gelatin molecule is enzyme-decomposed by adding thereto a gelatin decomposing enzyme. For the method, the description of R. J. Cox, *Photographic Gelatin II*, pages 233–251 and 335–346, Academic Press, London 1976, can be referred to.

In this case, since the bonding position of gelatin decomposed by the enzyme occurs at a specific structural position, low molecular weight gelatin having a relatively narrow molecular weight distribution is obtained. In this case, as the enzyme decomposition time is longer, a lower molecular weight of gelatin is obtained.

In another method of obtaining low molecular weight gelatin, ordinary gelatin is hydrolized by heating at low pH (e.g., pH 1 to 3) or high pH (e.g., pH 10 to 12).

The temperature of the protective colloid solution in the reaction vessel is higher than about 40° C., preferably higher than 50° C., and more preferably higher than about 60° C.

In this invention, an aqueous silver salt solution and an aqueous halide solution are not added to the reaction vessel during the nucleus formation and/or the crystal growth, but prior to the nucleus formation, an aqueous halide solution or an aqueous silver salt solution can be added to the reaction vessel for controlling pAg of the solution in the reaction vessel. Also, an aqueous halide solution or an aqueous silver salt solution can be added (temporarily or continuously) to the reaction vessel for controlling pAg of the solution in the reaction vessel during the formation of nuclei. Also, if necessary, an aqueous halide solution or an aqueous silver salt solution can be added to the reaction vessel by a so-called pAg control double jet method for keeping constant pAg of the solution in the reaction vessel.

The control process and apparatus of this invention are very effective for the production of various kinds of emulsions.

In the nucleus formation and/or grain growth of mixed crystal silver halide grains such as silver iodobromide, silver iodobromo-chloride, silver iodochloride, and silver chlorobromide, a microscopic heterogeneity of a halide composition is formed in the case of conventional production processes. Further, the occurrence of such a heterogeneity cannot be avoided even by performing the nucleus formation and/or the crystal growth by adding an aqueous halide solution and an aqueous silver salt solution of a constant halide composition to the reaction vessel. The microscopic heterogeneous distribution of halide can be easily confirmed by observing the transmitted images of the silver halide grains using a transmission type electron microscope.

For example, the microscopic heterogeneous distribution can be observed by the direct method using a transmission type electron microscope at low temperature described in J. F. Hamilton, *Photographic Science and Engineering*, Vol. 11, 57(1967) and Takekimi Shiozawa, *Journal of the Society of Photographic Science and Technology of Japan*, Vol. 35, No. 4, 213(1972). That is, silver halide grains released from a silver halide emulsion under a safe light such that the silver halide grains are not printed out are placed on a mesh for electron microscopic observation and the grains are observed by a transmission method in a state of being cooled by liquid nitrogen or liquid helium for preventing the silver halide grains from being damaged (printed out) by electron rays.

In this case, the higher the acceleration voltage of the electron microscope is, a clearer transmitted image is obtained, but it is preferred that the voltage be about 200 kvolts up to a thickness of the silver halide grains of about 0.25 μm and be about 1,000 kvolts up to a thickness of thicker than 0.25 μm. Since the higher the acceleration voltage is, the greater the damage to the grains by the irradiated electron rays will be, it is preferred that the sample being observed is cooled by liquid helium as opposed to liquid nitrogen.

The photographing magnification can be properly changed by the grain sizes of the sample being observed, but is usually from 20,000 to 40,000 magnifications.

In silver halide grains composed of a simple halide, there cannot be, as a matter of course, a heterogeneity in the halide distribution and hence only flat images are obtained in a transmission type electron microphotograph. On the other hand, in the case of mixed crystals composed of plural halides, a very fine annular ring-form striped pattern is observed.

For example, in the transmission type electron microphotograph of tabular silver iodobromide grains, a very fine annular ring-like striped pattern is observed at the portion of the silver iodobromide phase. The tabular grains were formed by using tabular silver bromide grains as the cores and forming a shell of silver iodobromide containing 10 mol % silver iodide on the outside of the core, and the structure thereof can be clearly observed by the transmission type electron microphotograph. That is, since the core portion is silver bromide and, as a matter of course, homogeneous, a homogeneous flat image only is obtained in the core portion. On the other hand, in the silver iodobromide phase, a very fine annular striped pattern can clearly be observed.

The interval of the striped pattern is very fine, e.g., along the order of 100 Å or lower, which shows a very microscopic heterogeneity.

It can be clarified by various methods that the very fine striped pattern shows the heterogeneity of a halide distribution, but in a direct method, it can be concluded that when the grains are annealed under the condition capable of moving iodide ions in the silver halide crystal (e.g., for 3 hours at 250° C.), the striped pattern completely vanishes.

No annular striped pattern is observed in the tabular silver halide grains prepared by the process of this invention and silver halide grains having a completely homogeneous silver iodide distribution is obtained in this invention. The site of the phase containing silver iodide in the grains may be the center of the silver halide grain, may be present throughout the whole grain, or at the outside of the grain. Also, the phase wherein silver iodide exists maybe one or plural.

Details of these techniques are described in Japanese Patent Applications 63-7851, 63-7852, and 63-7853. These inventions relate to the growth of grains, but the same effect is also apparent in the nucleus growth in this invention.

The silver halide content in the silver iodobromide phase or the silver iodochloride phase contained in the silver halide grains produced by the process of the invention is from 2 to 45 mol %, and preferably from 5 to 35 mol %. The total silver iodide content is more than about 2 mol %, more preferably at least 7 mol %, and particularly preferably at least 12 mol %.

The process of this invention is useful in the production of silver chlorobromide grains and by the process, silver chlorobromide grains having a completely homogeneous silver bromide (silver chloride) distribution can be obtained. In this case, the content of chloride is at least 10 mol %, and preferably at least 20 mol %.

Furthermore, the process of this invention is also very effective in the production of pure silver bromide or pure silver chloride. According to a conventional production process, the existence of a local variation of silver ions and halogen ions in a reaction vessel is unavoidable, the silver halide grains in the reaction vessel are brought into a different circumstance with respect to other portions by passing through such a locally heterogeneous portion. Hence, not only the heterogeneity of the grain growth occurs, but also reduced silver or fogged silver is formed in, for example, a highly concentrated portion of silver ions. Accordingly, in silver bromide or silver chloride, the occurrence of the heterogeneous distribution of the halide cannot take place, but another form of heterogeneity, as described above, occurs.

This problem is completely solved by the process of this invention.

The silver halide grains obtained by the process of this invention can be, as a matter of course, used for a surface latent image type silver halide emulsion and can also be used for inside latent image forming type emulsion and a direct reversal emulsion.

In general, the inside latent image forming type silver halide grains are superior to surface latent image forming type silver halide grains in the following aspects.

(1) A space charge layer is formed in silver halide crystal grains, electrons generated by light absorption move to the inside of the grain, and positive holes move to the surface. Accordingly, if latent image sites (electron trap sites), i.e., sensitive specks, are formed in the side of the grains, the occurrence of the recombinations of the electron and the positive hole is prevented, thereby the latent image formation is performed at a high efficiency and a high quantum sensitivity is realized.

(2) Since the sensitive specks exist in the interior of the grains, the silver halide grains are not influenced by moisture and oxygen, and thus are excellent in storage stability.

(3) Since the latent images formed by light exposure exist in the interior of the grains, the latent images are not influenced by moisture and oxygen, and the latent image stability is also high.

(4) When the silver halide emulsion is color or spectrally-sensitized by absorbing one or more sensitizing dyes on the surface of the silver halide grains of the emulsion, the light absorption sites (i.e., one or more sensitizing dyes on the surface of the grains) are separated from the interior latent image sites. Thus, the recombination of the dye positive holes and electrons is inhibited to prevent specific desensitization of the color sensitization, and a high color-sensitized sensitivity is thereby realized.

The inside latent image formation type silver halide grains have the aforementioned advantages as compared to surface latent image forming type silver halide grains. However, the silver halide grains have difficulty in the formation of sensitive specks in the interior of the grains. For forming sensitive specks in the interior of silver halide grains, after once forming silver halide grains as core grains, a chemical sensitization is applied to the grains to form sensitive specks on the core surfaces. Thereafter, silver halide is precipitated on the cores to form so-called shells thereon. However, the sensitive specks on the surface of the core grains obtained by the chemical sensitization of the cores are liable to change at the formation of the shells and are liable to frequently form inside fog. One of the reasons for this is that if the shell formation on the cores occurs at the heterogeneous portion of concentrations (silver ion concentration and halogen ion concentration) as in a conventional technique, the shells are damaged and the sensitive specks are liable to be changed into fogged nuclei. On the other hand, according to the process of this invention, the aforesaid problem is solved and an inside latent image forming type silver halide emulsion having much less inside fog is obtained.

For the inside latent image forming type silver halide grains, normal crystal grains and tabular grains are preferred, and the silver halide thereof is silver bromide, silver iodobromide and silver chlorobromide or silver chloroiodo-bromide having a silver chloride content of less than 30 mol % and is preferably silver iodobromide having a silver chloride content of less than 10 mol %.

In this case, the mol ratio of core/shell may be optional, but is preferably from 1/20 to ½, and more preferably from 1/10 to 1/3.

Also, in place of the interiorly chemically sensitized nuclei, a metal ion can be doped to the inside of the grains with the nuclei. The doping site may be the core, the core/shell interface, or the shell.

As the metal dopant, cadmium salts, lead salts, thalium salts, erbium salts, bismuth salts, iridium salts, rhodium salts or the complex salts thereof can be used. The metal ions are usually used in an amount of at least $10^{-6}$ mol per mol of silver halide.

The silver halide nucleus grains obtained by the process and apparatus of this invention further grow into silver halide grains having the desired grain sizes and a desired halide composition by performing the grain growth thereafter.

When the silver halide being grown is, in particular, mixed crystals such as silver iodobromide, silver iodochloro-bromide, silver chlorobromide, or silver iodochloride, it is preferred to perform the grain growth by the process and apparatus of this invention in succession to the formation of the nuclei.

Also, if necessary, it is preferred to perform the grain growth by adding a previously prepared fine grain silver halide emulsion to the reaction vessel. The details of the process are described in Japanese Patent Applications 63-7851, 63-7852, and 63-7853.

The silver halide grains thus obtained by the process and apparatus of this invention have the "completely homogeneous" halide distribution in both the nuclei and the grown phases of the grains and also the grain size variation thereof is very small.

There is no particular restriction on the mean grain size of the completely homogeneous silver halide grains obtained by the process and apparatus of this invention, but the mean grain size is preferably at least 0.3 μm, more preferably at least 0.8 μm, and particularly preferably at least 1.4 μm.

The silver halide grains obtained by the process and apparatus of this invention may have a regular crystal form (normal crystal grains) such as hexahedral, octahedral, dodecahedral, tetradecahedral, etracosahedral, and octacontahedral, an irregular crystal form such as spherical and potato-form, or various forms having at least one twin plane, in particular, hexagonal tabular twin grains or triangular tabular twin grains having two or three parallel twin planes.

The silver halide photographic emulsion obtained by the process and apparatus of this invention can be used for various silver halide photographic materials and various additives, the photographic processing process thereof, etc., are described in JP-A-63-123042, 63-106745, 63-106749, 63-100445, 63-71838, 63-85547, *Research Disclosure*, Vol. 176, No. 17643, ibid., Vol. 187, No. 18716.

The particular portions of the *Research Disclosures* (*RD*) are shown in the following table.

| | Additive | RD 17643 | RD 18716 |
|---|---|---|---|
| 1. | Chemical Sensitizer | p. 23 | p. 648, right column |
| 2. | Sensitivity Increasing | | p. 648, |

-continued

| | Additive | RD 17643 | RD 18716 |
|---|---|---|---|
| | Agent | | right column |
| 3. | Spectral Sensitizer, Super Color Sensitizer | pp. 23–24 | p. 648, right column-p. 649 right column |
| 4. | Whitening Agent | p. 24 | |
| 5. | Antifoggant and Stabilizer | pp. 24–25 | p. 649, right column |
| 6. | Light Absorber, Filter Dye, Ultraviolet Absorber | pp. 25–26 | p. 649, right column-p. 650, left column |
| 7. | Stain Inhibitor | p. 25, right column | p. 650, left to right columns |
| 8. | Dye Image Stabilizer | p. 25 | |
| 9. | Hardening Agent | p. 26 | p. 651, left column |
| 10. | Binder | p. 26 | p. 651, left column |
| 11. | Plasticizer, Lubricant | p. 27 | p. 650, right column |
| 12. | Coating Aid, Surface Active Agent | pp. 26–27 | p. 650, right column |
| 13. | Antistatic Agent | p. 27 | p. 650, right column |
| 14. | Color Coupler | p. 28 | pp. 647–648 |

The invention is explained more practically by the following example.

In the system of this invention as shown in FIG. 1(*a*), 1.5 mol of an aqueous silver nitrate solution, 1.5 mol of an aqueous potassium bromide solution, and an aqueous 1% gelatin solution prepared in each tank were added to the mixer 9 to form fine, silver halide grains in the mixer 9 and the fine grains were added to the reaction vessel 11 to perform the grain growth. In this case, a test of changing the silver ion potential in the mixer 9 from 0 mV to 40 mV was performed.

An electrode 12 was formed in the mixer 9 to detect the silver ion potential in the mixer during the reaction, and fine grains were formed while changing the silver ion potential as described above.

For this purpose, the flow rates of the aqueous silver nitrate solution and the silver potassium bromide solution may be controlled while fixing the flow rate of the other solution. In the test, the aforesaid silver ion potential was changed by controlling the flow rate of the aqueous potassium bromide solution, while fixing the flow rate of the aqueous silver nitrate solution.

The result showed that while in the case of performing no potential control, the silver ion potential was changed in the range of from 20 mV to 30 mV, in the aforesaid system of this invention employing the control system of the flow rate of the aqueous potassium bromide solution, the potential deviation or change was restrained to a range of ±4 mV, thereby silver halide grains having a homogeneous silver size distribution were obtained.

Also, a test of changing the silver ion potential in the reaction vessel within the range of from 0 to 20 mV in 50 minutes was performed utilizing the electrode 13 disposed in the reaction chamber 11. In this case, the system for controlling the flow rate of the aqueous potassium bromide solution being added to the mixer 9, while fixing the flow rate of the aqueous silver nitrate solution as in the aforesaid test, was employed.

The result showed that the silver ion potential could desirably be changed in a less deviation of the potential change, as in the aforesaid test, by controlling the flow rate of the aqueous potassium bromide solution being added to the mixer by means of the signal from the electrode in the reaction vessel.

The aforesaid effect cannot be obtained by only using the flow rate control through the measurement of the flow rates of the aqueous solutions being added to the mixer. However, the pAg control is possible by the present invention, thereby the homogeneous growth of silver halide crystals is performed.

The feature of this invention is as follows. The sizes and the form of the silver halide fine grains formed in the mixer can desirably be controlled by controlling pAg in the mixer at the formation of the fine grains in the mixer by supplying thereto an aqueous silver salt solution, an aqueous halide solution, and an aqueous protective colloid solution, or the grain growth condition in the reaction vessel can desirably be controlled by controlling pAg in the reaction vessel during the introduction of the fine, silver halide grains formed in the mixer into the reaction vessel. Thus, crystals of homogeneous silver halide grains are grown and the following advantages are obtained.

(1) Silver halide grains having a completely homogeneous halogen distribution are obtained as compared with silver halide grains obtained with conventional systems of supplying the aqueous solutions to the mixer.

(2) The silver halide grains formed have less fog.

(3) A silver halide emulsion excellent in sensitivity, gradation, graininess, sharpness, storage stability and pressure resistance is obtained.

What is claimed is:

1. A control process for the formation of silver halide grains comprising the steps of:

disposing a mixer outside of a reaction vessel containing an aqueous protective colloid solution and causing at least one of a nucleus formation and a crystal growth of silver halide grains, said mixer including a rotatable stirring blade;

supplying at various flow rates an aqueous solution of a water-soluble silver salt, an aqueous solution of a water-soluble halide, and an aqueous solution of a protective colloid to the mixer while controlling the flow rates of said aqueous solutions;

mixing the aqueous solutions while controlling the rotational speed of said stirring blade to form fine, silver halide grains; and immediately supplying the fine grains to the reaction vessel to perform said at least one of the nucleus formation and the crystal growth of the silver halide grains in the reaction vessel;

further comprising measuring a silver ion potential of the fine grains formed in the mixer or the silver ion potential in the reaction vessel, and controlling the flow rate of at least one of the aqueous silver salt solution, the aqueous halide solution, and the aqueous protective colloid solution being added to the mixer, such that a measured value of the silver ion potential equals a predetermined value.

* * * * *